US009457568B2

(12) United States Patent
Ikeda

(10) Patent No.: US 9,457,568 B2
(45) Date of Patent: Oct. 4, 2016

(54) INKJET HEAD AND INKJET RECORDING APPARATUS

(71) Applicant: TOSHIBA TEC KABUSHIKI KAISHA, Tokyo (JP)

(72) Inventor: Takahisa Ikeda, Nagaizumi Sunto Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/551,510

(22) Filed: Nov. 24, 2014

(65) Prior Publication Data

US 2015/0145929 A1 May 28, 2015

(30) Foreign Application Priority Data

Nov. 25, 2013 (JP) ..... 2013-242824

(51) Int. Cl.
*B41J 2/14* (2006.01)
*B41J 1/18* (2006.01)

(52) U.S. Cl.
CPC ..... *B41J 2/14209* (2013.01); *B41J 1/18* (2013.01); *B41J 2002/14306* (2013.01); *B41J 2002/14403* (2013.01); *B41J 2202/12* (2013.01)

(58) Field of Classification Search
None
See application file for complete search history.

(56) References Cited

U.S. PATENT DOCUMENTS 5,453,770 A * 9/1995 Katakura et al. ..... 347/85
6,109,734 A * 8/2000 Kashino et al. ..... 347/65
2002/0130918 A1* 9/2002 Hayakawa et al. ..... 347/29
2003/0146952 A1* 8/2003 Numata et al. ..... 347/23
2003/0197755 A1* 10/2003 Murakami ..... 347/40
2007/0229608 A1* 10/2007 Steiner ..... 347/73
2008/0246813 A1* 10/2008 Murakami et al. ..... 347/54
2009/0096838 A1* 4/2009 Chino et al. ..... 347/56
2009/0231394 A1* 9/2009 Inoue et al. ..... 347/67
2012/0026227 A1* 2/2012 Tanaka et al. ..... 347/9
2012/0120158 A1* 5/2012 Sakai et al. ..... 347/65
2014/0118440 A1* 5/2014 Kubota ..... 347/40

FOREIGN PATENT DOCUMENTS

JP 2009-196122 A 9/2009
JP 4671525 B2 4/2011
JP 5422529 B2 2/2014

* cited by examiner

*Primary Examiner* — Justin Seo
(74) *Attorney, Agent, or Firm* — Patterson & Sheridan, LLP

(57) ABSTRACT

An inkjet head includes a plurality of nozzles, a plurality of pressure chambers arranged along a first direction, each of which extends in a second direction crossing the first direction, communicates with one of the nozzles, and has a first end through which ink is supplied and a second end through which ink is recycled, a plurality of ink inlets configured on a side of the first ends of the pressure chambers through which ink is supplied to the pressure chambers, and a plurality of ink outlets configured on a side of the second ends of the pressure chambers through which ink is recycled from the pressure chambers. A flow rate of the ink flowing from a ink inlet to an ink outlet through pressure chambers that are at the ends along the arrangement positions of the pressure chambers is higher than a flow rate of the ink flowing from an ink inlet to an ink outlet through pressure chambers that are at the center along the arrangement positions of the pressure chambers.

19 Claims, 3 Drawing Sheets

INKJET HEAD AND INKJET RECORDING APPARATUS

CROSS-REFERENCE TO RELATED APPLICATION

This application is based upon and claims the benefit of priority from Japanese Patent Application No. 2013-242824, filed Nov. 25, 2013, the entire contents of which are incorporated herein by reference.

FIELD

Embodiments described herein relate to an inkjet head and an inkjet recording apparatus.

BACKGROUND

An inkjet recording apparatus has been used as an apparatus for outputting data such as image. The inkjet recording apparatus uses an inkjet head that ejects tiny ink drops onto a recording medium such as paper.

For use as such an inkjet head, a type of inkjet head is known which circulates ink using, for example, pressure chambers formed therein. This type of inkjet head comprises a plurality of ink inlets arranged on one end of a substrate, a plurality of ink outlets arranged on the other end of the substrate, a plurality of nozzles arranged between the ink inlets and the ink outlets, a piezoelectric element arranged nearby the nozzles to cause ink drops to be ejected from the nozzles, a drive IC for driving the piezoelectric element, and a wire for connecting the drive IC to the piezoelectric element.

In such an inkjet head, the ink supplied from ink inlets is fed to a plurality of pressure chambers and the nozzles arranged in the center of the pressure chambers so that ink drops are ejected from the nozzles when the piezoelectric elements of the pressure chambers are driven. The ink not ejected through the nozzles is recycled through the ink outlets. The recycled ink is fed back into the pressure chambers again through the ink inlets.

In this way, the ink to be used is recycled, preventing the generation of nozzle bubbles and the solidification of an ink block in the inkjet head.

DETAILED DESCRIPTION

In accordance with the present embodiment, an inkjet head comprises a plurality of nozzles, a plurality of pressure chambers arranged along a first direction, each of which extends in a second direction crossing the first direction, communicates with one of the nozzles, and has a first end through which ink is supplied and a second end through which ink is recycled, a plurality of ink inlets configured on a side of the first ends of the pressure chambers through which ink is supplied to the pressure chambers, and a plurality of ink outlets configured on a side of the second ends of the pressure chambers through which ink is recycled from the pressure chambers. A flow rate of the ink flowing from a ink inlet to an ink outlet through pressure chambers that are at the ends along the arrangement positions of the pressure chambers is higher than a flow rate of the ink flowing from an ink inlet to an ink outlet through pressure chambers that are at the center along the arrangement positions of the pressure chambers.

The present embodiment is described below in detail with reference to the accompanying drawings.

Figure 1:
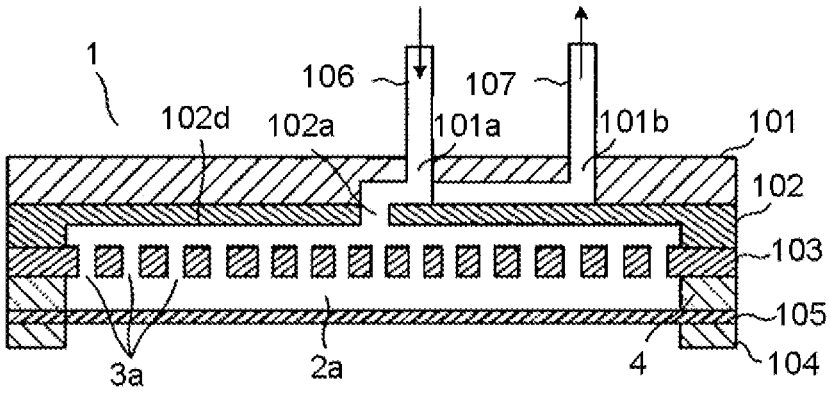
FIG. 1 is a cross-sectional view of an inkjet head according to an embodiment.
Figure 2:
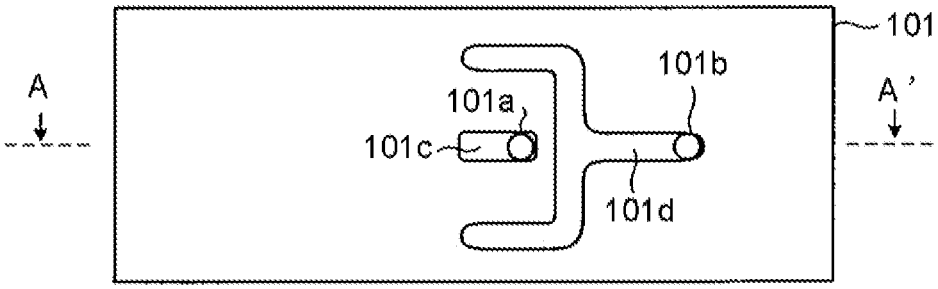
FIG. 2 is a schematic diagram illustrating the structure of the first layer of substrate of the inkjet head according to the embodiment when viewed from below.
Figure 3:
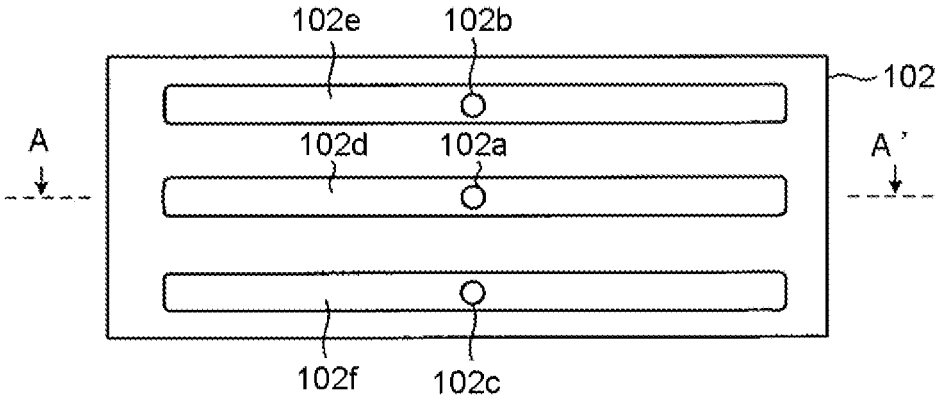
FIG. 3 is a schematic diagram illustrating the structure of the second layer of substrate of the inkjet head according to the embodiment when viewed from below.
Figure 4:
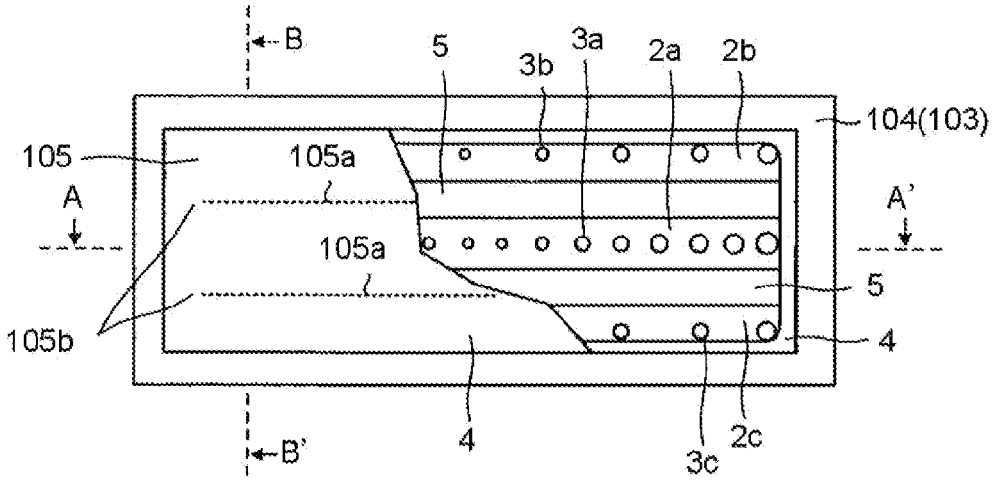
FIG. 4 is a schematic diagram illustrating the structures of the third and the fourth layers of substrates of the inkjet head according to the embodiment when viewed from below.
Figure 5:
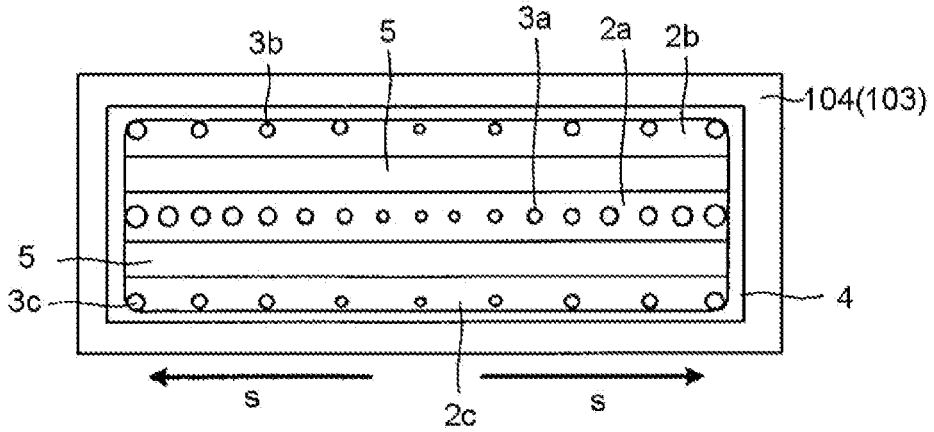
FIG. 5 is a diagram illustrating a state in which a nozzle plate is removed from the structure shown in FIG. 4.
Figure 6:
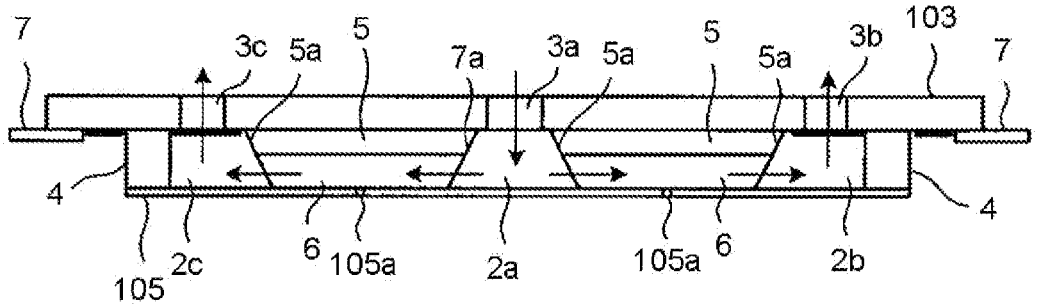
FIG. 6 is a schematic diagram illustrating the cross-section taken along line B-B' shown in FIG. 4 of the inkjet head shown in FIG. 4.
Figure 7:
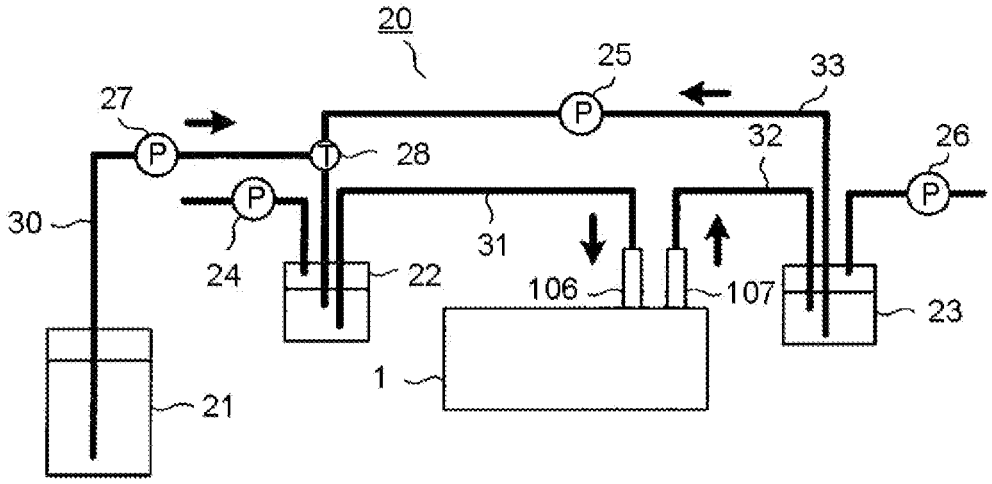
FIG. 7 is a schematic diagram illustrating the structure of an ink supply unit for supplying ink to the inkjet head shown in FIG. 1.
Figure 8:
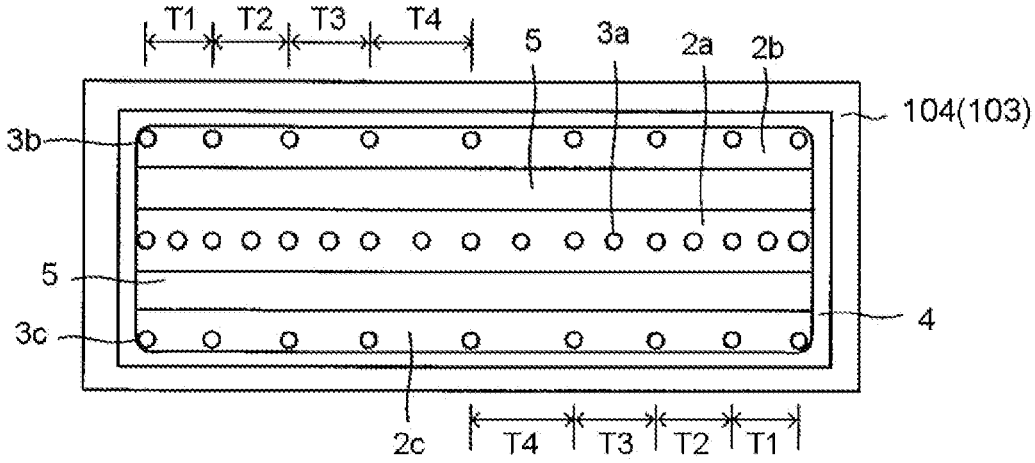
FIG. 8 is a schematic diagram illustrating the structure of an inkjet head according to another embodiment.

FIG. 1 is a cross-sectional view of the inkjet head according to the present embodiment; FIG. 2 and FIG. 3 are schematic diagrams illustrating the structures of the first and the second layers of substrates of the inkjet head according to the embodiment when viewed from below; FIG. 4 is a schematic diagram illustrating the structures of the third and the fourth layers of substrates of the inkjet head according to the embodiment when viewed from below; FIG. 5 is a diagram illustrating a state in which a nozzle plate is removed from the structure shown in FIG. 4; FIG. 6 is a schematic diagram illustrating the cross-section taken along line B-B' shown in FIG. 4 of the inkjet head shown in FIG. 4; FIG. 7 is a schematic diagram illustrating the structure of an ink supply unit for supplying ink to the inkjet head shown in FIG. 1; and FIG. 8 is a schematic diagram illustrating the structure of an inkjet head according to another embodiment. Further, FIG. 1 corresponds to the cross-section taken along line A-A' shown in FIGS. 2-4.

As shown in FIG. 1, an inkjet head 1 comprises, from the top down, multiple layers of a substrate including a first layer 101, a second layer 102, a third layer 103 and a fourth layer 104, and a nozzle plate 105 which is arranged between the third layer 103 and the fourth layer 104.

As shown in FIG. 1 and FIG. 2, the first layer 101 comprises an ink inlet 101*a* for supplying ink to the center part of the first layer 101 from an ink supply unit which will be described later and an ink outlet 101*b* for recycling the ink from the inkjet head 1. The ink inlet 101*a* and the ink outlet 101*b*, which are connected with an ink supply tube 106 and an ink recycling tube 107, respectively, are connected with the ink supply unit. Further, an ink supply path 101*c* for conveying ink from the ink inlet 101*a* to the second layer 102 and an ink recycling path 101*d* for conveying the ink from the second layer 102 to the ink outlet 101*b* are arranged in the center part of the first layer 101.

As shown in FIG. 3, the second layer 102 comprises an ink supply path 102*d* and ink recycling paths 102*e* and 102*f*, on which an ink inlet 102*a* and ink outlets 102*b* and 102*c* are arranged at positions corresponding to two ends of the ink supply path 101*c* and the ink recycling path 101*d* of the first layer 101, and which respectively extends in the longitudinal direction of the second substrate 102 from the ink inlet 102*a* and the ink outlets 102*b* and 102*c*. Further, as to the configuration of the ink supply path 102*d* and the ink recycling paths 102*e* and 102*f*, for example, the upper portions of the ink supply path 102*d* and the ink recycling paths 102*e* and 102*f* may be substantially parallel to each other from the ink inlet 102*a* and the ink recycling paths 102*b* and 102*c* to two ends in the longitudinal direction of the ink supply path 102*d* and the ink recycling paths 102*e* and 102*f*, as shown in FIG. 1. However, the present invention is not limited to this, the ink supply path 102*d* and the ink recycling paths 102*e* and 102*f* may also be inclined downwards from the ink inlet 102*a* and the ink recycling paths 102*e* and 102*f* along two ends in the longitudinal direction of the ink supply path 102*d* and the ink recycling paths 102*e* and 102*f*.

As shown in FIG. 4 and FIG. 5, the third layer 103 comprises an ink supply path 2*a* and ink recycling paths 2*b* and 2*c* located at positions corresponding to the ink supply path 102*d* and the ink recycling paths 102*e* and 102*f* of the second layer 102, that is, extending in the longitudinal direction of the third layer 103. A plurality of ink inlets 3*a* and a plurality of ink outlets 3*b* and 3*c* in respective communication with the ink supply path 102*d* and the ink recycling paths 102*e* and 102*f* of the second layer 102 are arranged on the ink supply path 2*a* and the ink recycling paths 2*b* and 2*c* at specific intervals.

No specific limitation is given to the number of the ink inlets 3*a* and the ink outlets 3*b* and 3*c* arranged on the third layer 103, and in the present embodiment, the number of the ink inlets 3*a* may be equal to that of the ink outlets 3*b* and 3*c*. Moreover, the number of the ink outlets 3*b* and 3*c* in respective communication with the ink recycling paths 102*e* and 102*f* may be half of that of the ink inlets 3*a* in communication with the ink supply path 102*d* because two ink recycling paths are arranged with respect to one ink supply path in the present embodiment.

The size of the openings of the ink inlet 3*a* and the ink outlets 3*b* and 3*c* in the two end parts in the longitudinal direction of the ink supply path 2*a* and the ink recycling paths 2*b* and 2*c* are larger than the size of the openings of the ink inlet 3*a* and the ink outlets 3*b* and 3*c* in the center part in the longitudinal direction of the ink supply path 2*a* and the ink recycling paths 2*b* and 2*c*.

A nozzle plate 105 is arranged on the third layer 103 via a frame 4 and a piezoelectric element 5 which are arranged on the outer edge of the third layer 103. The nozzle plate 105 formed by tetragonal polyimide film comprises a pair of nozzle columns 105*b* consisting of a plurality of nozzles 105*a*.

As shown in FIG. 4 and FIG. 5, the piezoelectric element 5 is located inside the frame 4. In addition, the piezoelectric elements 5 are arranged in pairs between the ink inlet 3*a* and the ink outlet 3*b* and between the ink inlet 3*a* and the ink outlet 3*c* and extended in the direction of the nozzle columns 105*b* of the nozzle plate 105. The piezoelectric element 5 is made from, for example, PZT (lead zirconate titanate: $Pb(Zr,Ti)O_3$). A plurality of pressure chambers 6 cut into a groove shape are formed on the surface of the piezoelectric element 5. As shown in FIG. 6, with two inclined lateral sides 5*a*, the piezoelectric element 5 has a trapezoidal-shaped section. The pressure chambers 6 are arranged opposite to the nozzles 105*a*. That is, one end of the plurality of pressure chambers 6 which are formed on the piezoelectric element 5 and respectively communicated with the nozzle 105*a* is communicated with the ink supply path while the other end is communicated with the ink recycling path. In addition, the plurality of pressure chambers 6 is arranged in the same direction as the nozzles 105*a*. The piezoelectric element 5 is connected with a head drive IC 7 for driving the piezoelectric element 5.

Electrodes are arranged on the internal lateral sides and the internal bottom of each pressure chamber 6, the electrodes generate an electric field according to a drive signal sent from the head drive IC 7 to deflect the inside of the pressure chamber 6 inwards to reduce the internal volume of the pressure chamber 6 to cause ink drops ejected through the nozzle 105*a*.

As shown in FIG. 6, the ink supply path 2*a* is a space surrounded by the third layer 103, the nozzle plate 105 and the pair of piezoelectric elements 5. Ink is supplied into each pressure chamber 6 from the plurality of ink inlets 3*a* arranged on the third layer 103. The ink inlets 3*a* are arranged along the arrangement direction of the pressure chambers 6 at given intervals. The ink inlets 3*a* are gradually increased in size from the center part of the pressure chambers 6 to the two end parts of the pressure chambers 6 (the arrow S shown in FIG. 5). In other words, the ink inlets 3*a* are gradually increased in size from the center part of the third layer 103 to the two end parts of the third layer 103. Thus, the ink inlets 3*a* arranged in the two end parts of the third layer 103 feed more ink than those arranged in the center part of the third layer 103.

As shown in FIG. 6, the ink recycling paths 2*b* and 2*c* are spaces surrounded by the third layer 103, the frame 4, the nozzle plate 105 and the piezoelectric element 5. Ink is recycled into the plurality of ink outlets 3*b* and 3*c* arranged on the third layer 103 from each pressure chamber 6. The ink outlets 3*b* and 3*c* are arranged at given intervals along the arrangement direction of the pressure chambers 6. The ink outlets 3*b* and 3*c* are gradually increased in size from the center part of the pressure chambers 6 to the two end parts of the pressure chambers 6 (the arrow S shown in FIG. 5). In other words, the ink outlets 3*b* and 3*c* are gradually increased in size from the center part of the third layer 103 to the two end parts of the third layer 103. Thus, more ink is recycled through the ink outlets 3*b* and 3*c* arranged on the two ends of the third layer 103 than through the ink outlets 3*b* and 3*c* arranged in the center part of the third layer 103.

Generally, because the ink inlet 102*a* and the ink outlets 102*b* and 102*c* in communication with the first layer 101 are located in the center part of the second layer 102 in the longitudinal direction of the second layer 102, the flow rate of the ink passing through the pressure chambers near the two end parts of the second layer 102 is smaller than that of the ink passing through the pressure chambers near the center part of the second layer of substrate, and it takes a longer time to recycle the ink fed from the ink inlet 102*a* and passing through the pressure chambers 6 in the two end parts of the second layer 102 into the ink outlets 102*b* and 102*c* than to recycle the ink fed from the ink inlet 102*a* and passing through the pressure chambers 6 in the center part of the second layer 102 into the ink outlets 102*b* and 102*c*. The inequality of ink flow causes a problem in that it is likely that no ink is ejected from the nozzles in the two end parts of the second layer 102 where ink flow rate is small when ink circulation operation is re-operated after it is ended. Especially, it is more likely that no ink is ejected from the nozzles in the two end parts of the second layer 102 when an ink having a pigment of a high specific gravity is used.

To solve the problem, in the present embodiment, the ink inlet 3*a* and the ink outlets 3*b* and 3*c* on the third layer 103, which are conventionally set to have the same size opening in the arrangement direction of the pressure chambers 6, are gradually increased in size from the center to the two ends along the arrangement direction of the pressure chambers 6, thereby increasing the flow rate of the ink in the two end parts. Accordingly, the ink pigment which is likely to be accumulated in the pressure chambers in the two end parts of the inkjet head can be quickly and effectively recycled to prevent the image degradation caused by the non-ejection of ink.

The ink having a pigment of relatively large diameter may be metallic ink having aluminum pigment, metallic ink the raw material of which is copper, argentums, gold or other metals having a large specific gravity, white ink using titanium oxide as pigment, ceramic ink, and the like.

In the inkjet head 1 of the present embodiment, ink is supplied and recycled by an ink supply unit 20 which, as shown in FIG. 7, comprises a main ink tank 21, a supply-side ink tank 22, a recycling-side ink tank 23, a supply-side pressure adjustment pump 24, a transport pump 25, a recycling-side pressure adjustment pump 26, a main ink tank transfer pump 27, an ink supply tube 106, an ink recycling tube 107 and a main ink tank supply valve 28.

The main ink tank 21 is connected with the supply-side ink tank 22 by a tube 30 so as to supply ink to the supply-side ink tank 22 through the main ink tank transport pump 27 as the inkjet head 1 consumes ink. The main ink tank supply valve 28 is opened when ink is fed from the main ink tank 21 to the supply-side ink tank 22.

The supply-side ink tank 22 is connected with the ink supply tube 106 through a tube 31 so as to supply ink to the inkjet head 1 through the ink supply tube 106. The recycling-side ink tank 23 is connected with the ink recycling tube 107 through a tube 32 so as to temporarily store the ink recycled from the inkjet head 1 through the ink recycling tube 107.

The supply-side pressure adjustment pump 24 and the recycling-side pressure adjustment pump 26 adjust the pressure of the supply-side ink tank 22 and the pressure of the recycling-side ink tank 23, respectively. The transport pump 25 is arranged on a tube 33 which connects the feeding-side ink tank 22 with the recycling-side ink tank 23 so as to realize the reflow of the ink stored in the recycling-side ink tank 23 into the supply-side ink tank 22.

The ink supply unit 20 circulates ink through a path consisting of the inkjet head 1, the supply-side ink tank 22, the recycling-side ink tank 23 and the transport pump 25.

As another embodiment, the ink inlet 3*a* and the ink outlets 3*b* and 3*c*, which have the same opening size, are arranged more densely in the two end parts of the ink supply path 2*a* and the ink recycling paths 2*b* and 2*c* than in the center part of the ink supply path 2*a* and the ink recycling paths 2*b* and 2*c*, as shown in FIG. 8. In other words, the ink inlet 3*a* and the ink outlets 3*b* and 3*c* are arranged in the two end parts of the ink supply path 2*a* and the ink recycling paths 2*b* and 2*c* at a shorter interval (arrows T1-T4 shown in FIG. 8) than in the center part of the ink supply path 2*a* and the ink recycling paths 2*b* and 2*c*. With this structure, the flow rate of the ink flowing from the ink inlet 3*a* to the ink recycling paths 3*b* and 3*c* through the pressure chambers 6 is higher in two end parts of the ink supply path 2*a* and the ink recycling paths 2*b* and 2*c* than in the center part of the ink supply path 2*a* and the ink recycling paths 2*b* and 2*c*. In the embodiment, the structure of the present embodiment is added in which the opening sizes of the ink inlets and the ink outlets in the center part and the two end parts of the ink supply path 2*a* and the ink recycling paths 2*b* and 2*c* are changed, in this way, the flow rate of the ink in the center part of the ink supply path 2*a* and the ink recycling paths 2*b* and 2*c* further may be made different from that of the ink in two end parts of the ink supply path 2*a* and the ink recycling paths 2*b* and 2*c*.

What is claimed is:

1. An inkjet head, comprising:

a plurality of nozzles;

a plurality of pressure chambers arranged along a first direction, each of which extends in a second direction crossing the first direction, communicates with one of the nozzles, and has a first end through which ink is supplied and a second end through which ink is recycled;

a plurality of ink inlets configured on a side of the first ends of the pressure chambers through which ink is supplied to the pressure chambers; and a plurality of ink outlets configured on a side of the second ends of the pressure chambers through which ink is recycled from the pressure chambers, wherein a flow rate of the ink flowing from an ink inlet to an ink outlet through pressure chambers that are at the ends along the arrangement positions of the pressure chambers is higher than a flow rate of the ink flowing from an ink inlet to an ink outlet through pressure chambers that are at the center along the arrangement positions of the pressure chambers.

2. The inkjet head according to claim 1, wherein the ink inlets and the ink outlets have different opening sizes along the arrangement positions of the pressure chambers.

3. The inkjet head according to claim 2, wherein the ink inlets and the ink outlets at the ends of the arrangement positions of the pressure chambers have larger size openings than the ink inlets and the ink outlets at the center of the arrangement positions of the pressure chambers.

4. The inkjet head according to claim 3, wherein the opening size of the ink inlets and the ink outlet is gradually increased from the center of the arrangement positions of the pressure chambers to the ends of the arrangement positions of the pressure chambers.

5. The inkjet head according to claim 1, wherein the ink inlets and the ink outlets are arranged at different intervals along the arrangement positions of the pressure chambers.

6. The inkjet head according to claim 5, wherein the ink inlets and the ink outlets at the center of the arrangement positions of the pressure chambers are spaced from each other more than the ink inlets and the ink outlets at the ends of the arrangement positions of the pressure chambers.

7. The inkjet head according to claim 6, wherein all of the ink inlets and the ink outlets have the same size openings.

8. The inkjet head according to claim 6, wherein the ink inlets and the ink outlets have different opening sizes along the arrangement positions of the pressure chambers.

9. The inkjet head according to claim 8, wherein the ink inlets and the ink outlets at the ends of the arrangement positions of the pressure chambers have larger size openings than the ink inlets and the ink outlets at the center of the arrangement positions of the pressure chambers.

10. An inkjet recording apparatus comprising:

an inkjet head that includes a plurality of nozzles, plurality of pressure chambers arranged along a first direction, each of which extends in a second direction crossing the first direction, communicates with one of the nozzles, and has a first end through which ink is supplied and a second end through which ink is recycled, a plurality of ink inlets configured on a side of the first ends of the pressure chambers through which ink is supplied to the pressure chambers, and a plurality of ink outlets configured on a side of the second ends of the pressure chambers through which ink is recycled from the pressure chambers, wherein a flow rate of the ink flowing from an ink inlet to an ink outlet through pressure chambers that are at the ends along the arrangement positions of the pressure chambers is higher than a flow rate of the ink flowing from an ink inlet to an ink outlet through pressure chambers that are at the center along the arrangement positions of the pressure chambers.

11. The inkjet recording apparatus according to claim 10, wherein the ink inlets and the ink outlets have different opening sizes along the arrangement positions of the pressure chambers.

12. The inkjet recording apparatus according to claim 11, wherein the ink inlets and the ink outlets at the ends of the arrangement positions of the pressure chambers have larger size openings than the ink inlets and the ink outlets at the center of the arrangement positions of the pressure chambers.

13. The inkjet recording apparatus according to claim 12, wherein the opening size of the ink inlets and the ink outlet is gradually increased from the center of the arrangement positions of the pressure chambers to the ends of the arrangement positions of the pressure chambers.

14. The inkjet recording apparatus according to claim 10, wherein the ink inlets and the ink outlets are arranged at different intervals along the arrangement positions of the pressure chambers.

15. The inkjet recording apparatus according to claim 14, wherein the ink inlets and the ink outlets at the center of the arrangement positions of the pressure chambers are spaced from each other more than the ink inlets and the ink outlets at the ends of the arrangement positions of the pressure chambers.

16. The inkjet recording apparatus according to claim 15, wherein all of the ink inlets and the ink outlets have the same size openings.

17. The inkjet recording apparatus according to claim 15, wherein the ink inlets and the ink outlets have different opening sizes along the arrangement positions of the pressure chambers.

18. The inkjet recording apparatus according to claim 17, wherein the ink inlets and the ink outlets at the ends of the arrangement positions of the pressure chambers have larger size openings than the ink inlets and the ink outlets at the center of the arrangement positions of the pressure chambers.

19. An inkjet head, comprising:

a plurality of nozzles;

a plurality of pressure chambers arranged along a first direction, each of which extends in a second direction crossing the first direction, communicates with one of the nozzles, and has a first end through which ink is supplied and a second end through which ink is recycled;

a plurality of ink inlets configured on a side of the first ends of the pressure chambers through which ink is supplied to the pressure chambers; and a plurality of ink outlets configured on a side of the second ends of the pressure chambers through which ink is recycled from the pressure chambers, wherein opening sizes of the ink inlets and the ink outlets vary along the arrangement positions of the pressure chambers;

wherein the opening sizes of the ink inlets and the ink outlets are the smallest at the center of the arrangement positions of the pressure chambers and the largest at the ends of the arrangement positions of the pressure chambers.

* * * * *